United States Patent [19]

Langen

[11] Patent Number: 4,537,587

[45] Date of Patent: Aug. 27, 1985

[54] CARTON OPENING MECHANISM

[75] Inventor: Marinus J. M. Langen, Rexdale, Canada

[73] Assignee: H. J. Langen & Sons Limited, Mississauga, Canada

[21] Appl. No.: 521,576

[22] Filed: Aug. 9, 1983

[51] Int. Cl.[3] ..... B31B 1/78; B31B 1/80

[52] U.S. Cl. ..... 493/315; 493/318

[58] Field of Search ..... 493/315, 317, 318

[56] References Cited

U.S. PATENT DOCUMENTS

| | | | |
|---|---|---|---|
| 2,671,385 | 3/1954 | Johenning et al. | 493/315 |
| 2,887,022 | 5/1959 | Lubersky et al. | 493/315 |
| 3,242,827 | 3/1966 | Winters | 493/315 |
| 3,783,752 | 1/1974 | Langen et al. | 493/315 |
| 3,937,458 | 2/1976 | Langen | 271/95 |
| 4,389,205 | 6/1983 | Righi | 493/315 |

*Primary Examiner*—Lowell A. Larson
*Assistant Examiner*—William E. Terrell
*Attorney, Agent, or Firm*—Fetherstonhaugh & Co.

[57] ABSTRACT

A carton opening mechanism for use in opening knocked-down cartons has a carton storage magazine which has a discharge opening. The mechanism has a first suction face which is circumferentially spaced 120 degrees from the discharge opening of the magazine. The mechanism is mountable so as to locate the receiver compartment equidistant from the discharge opening and first suction face. A rotary transfer mechanism is mounted for rotation about the central axis and has a suction head formed with a transfer suction face. The transfer suction face is moves between, a first position in which it is directed toward the discharge opening and positioned to engage a wall of a carton blank located in the storage magazine and, a second position in which it is directed toward and disposed opposite the first suction face of a carton opening mechanism to press an opposite wall of the carton into engagement with the first suction face, and, a third position in which it is directed toward and disposed adjacent the entranceway of the receiver to deposit an open carton in a receiver compartment. The transfer mechanism then returns to the first position. A suction control mechanism is provided to generate a negative pressure at said transfer suction face when it is required.

3 Claims, 4 Drawing Figures

CARTON OPENING MECHANISM

This invention relates to a carton opening mechanism. In particular, this invention relates to a carton opening mechanism for use in a carton loading machine.

Cartons are frequently stored in a flat knocked-down configuration and must be opened to a tubular sleeve configuration in order to be loaded. Considerable difficulty has long been experienced in providing a reliable carton opening mechanism. Frequently, cartons are withdrawn from a storage magazine in which they are stored in a knocked-down configuration and are driven edge first against a stop with the intention that engagement with the stop will cause the various panels to move to the direct open configuration by folding along the hinge lines which connect the panels. This mechanism is, however, unreliable in that in many instances, the cartons will fold along a line which is not a hinge line and will not therefore open to the required configuration.

Other complex mechanisms have been provided in an attempt to overcome these difficulties, however, the complexity of these mechanisms has been such that they are difficult to maintain in good working order and difficulty is experienced in operating these mechanisms at high speed.

It is an object of the present invention to provide a simple and efficient carton opening mechanism which is capable of operating at high speeds.

SUMMARY OF INVENTION

According to one aspect of the present invention, a carton opening mechanism for use in opening knocked-down cartons comprises a carton storage means having a discharge opening through which knocked-down cartons may be withdrawn one at a time, carton opening means having a first suction face, said discharge opening and first suction face being circumferentially spaced 120 degrees from one another about the perimeter of a circle and facing inwardly toward a central axis located at the center of said circle, said mechanism being mountable so as to locate the receiver compartment on the perimeter of said circle equidistant from the discharge opening and first suction face with the entranceway of said compartment opening toward said central axis, a rotary transfer means mounted for rotation about said central axis, said transfer having a suction head formed with a transfer suction face, said transfer suction face being movable, in response to rotation of said transfer means, between, a first position in which the transfer suction face is directed toward said discharge opening and positioned to engage a wall of a carton blank located in the storage means in use, a second position in which the transfer suction face is directed toward and disposed opposite the first suction face of a carton opening means to press an opposite wall of the carton into engagement with the first suction face, and, a third position in which the transfer suction face is directed toward and disposed adjacent the entranceway of the receiver to deposit an open carton in a receiver compartment in use, the transfer means then returning to the first position, suction control means adapted to generate a negative pressure at said transfer suction face when it is in said first position and during movement of said transfer suction face between said first, second and third positions so as to secure a wall of a knocked-down carton thereto, withdraw it from the storage means, transported to and open it by engagement with the opening means and deposit the open carton in the receiver compartment and thereafter to relieve the negative pressure to release the open carton.

The invention will be more clearly understood after reference to the following detailed specification read in conjunction with the drawings wherein.

Figure 1:
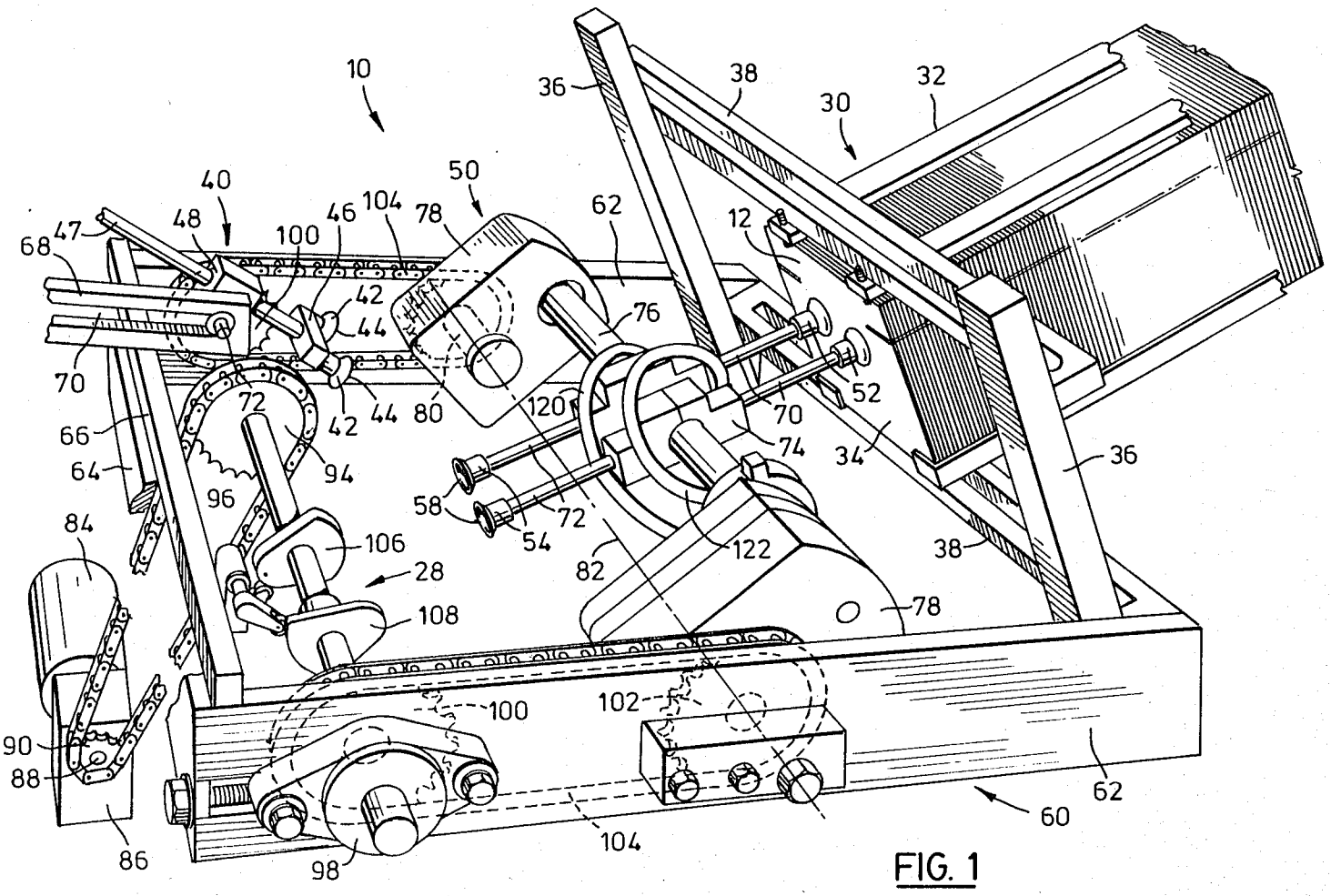
FIG. 1 is a pictorial view of a carton opening mechanism constructed in accordance with an embodiment of the present invention.
Figure 2:
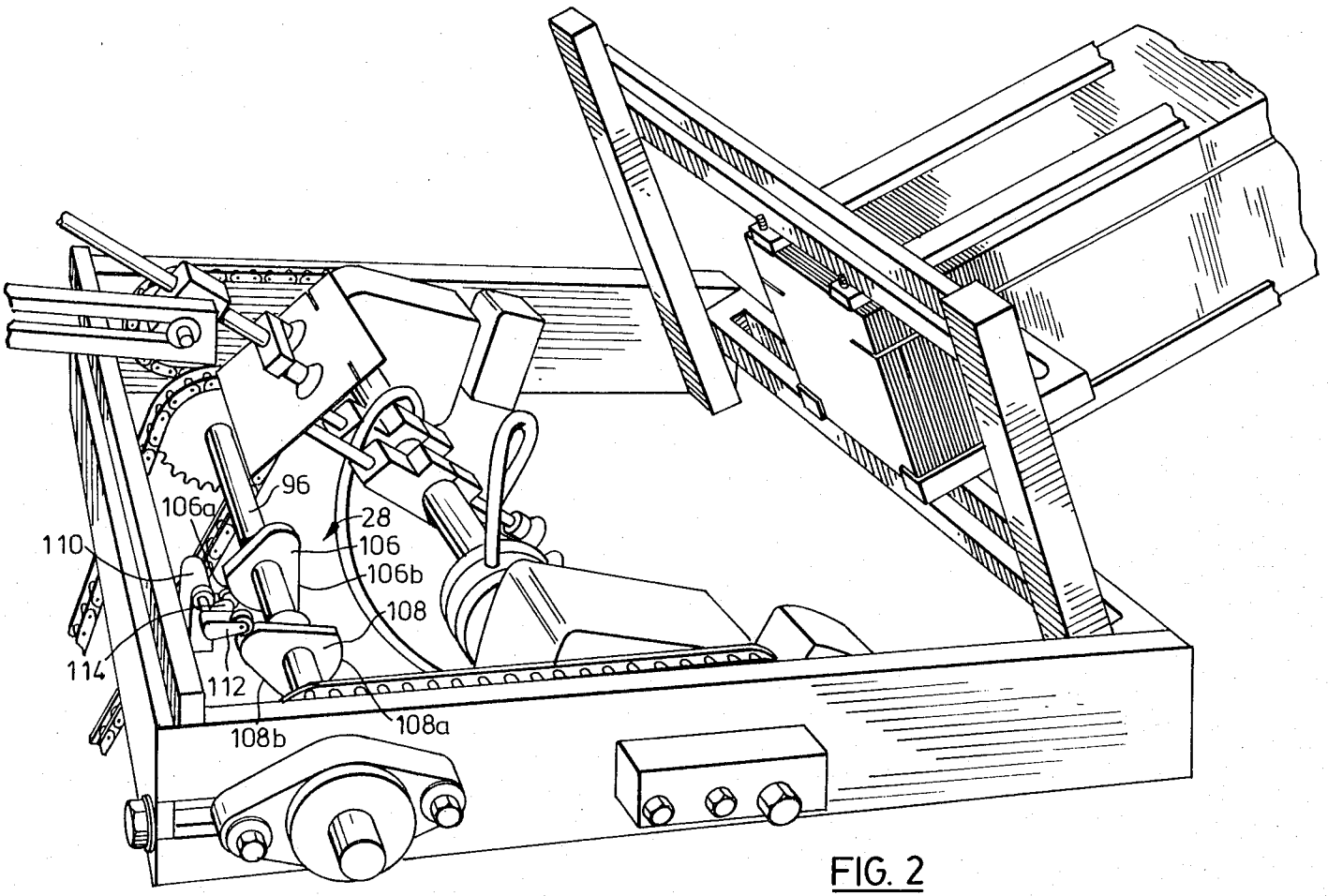
FIG. 2 is a top view similar to FIG. 1 showing the mechanism in a second position.

With reference to FIG. 1 of the drawings, the reference numeral 10 refers generally to a carton opening mechanism constructed in accordance with an embodiment of the present invention.

Figure 4:
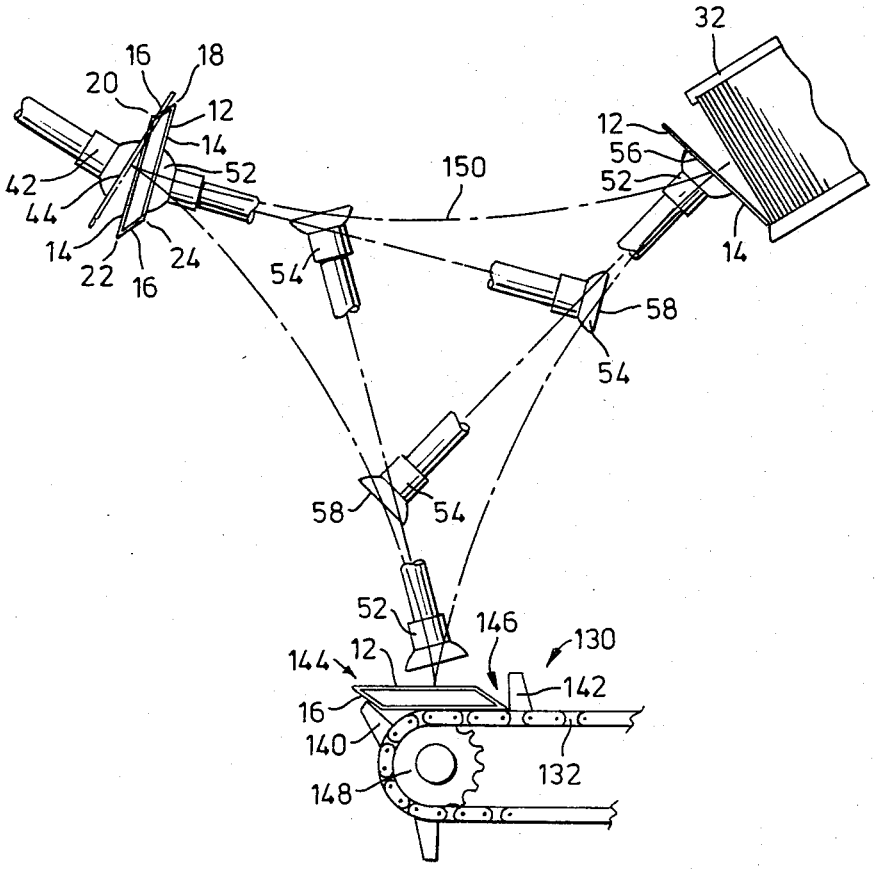
FIG. 4 is an end view of the mechanism showing the various positions of the rotary transfer mechanism.

The carton opening mechanism is designed to open knocked-down cartons 12, each of which as shown in FIG. 4 of the drawings, is formed with oppositely disposed main panels 14 which are connected to side wall panels 16 along hinges 18, 20, 22 and 24. In a knocked-down configuration, the cartons 12 are folded along hinge lines 18 and 22 with one main panel 14 and one side panel 16 being disposed on opposite sides of the hinge lines 18 and 22 in a face-to-face relationship.

Referring once again to FIG. 1 of the drawings, it will be seen that the carton opening mechanism 10 includes a carton storage means generally identified by the reference numeral 30, a carton opening means generally identified by the reference numeral 40 and a rotary transfer means generally identified by the reference numeral 50. A frame generally identified by the reference numeral 60 serves to support the carton storage means 30, carton opening means 40 and rotary transfer means 50 in an operable position.

The carton storage means 30 comprises a carton storage magazine 32 which has a discharge opening 34 through which knocked-down cartons 12 may be withdrawn one at a time. Carton storage magazines of this type are well known and consequently, the mechanism which controls the dispensing of the cartons to ensure that they are discharged one at a time, will not be described herein. The magazine 32 is supported by transverse beams 38 and support columns 36 so as to be size adjustable to accommodate cartons of different dimensions. The support columns 36 and transfer beams 38 form components of the frame 60. The frame 60 also includes longitudinal beams 62 which are connected by transverse beams 64 and 66.

The carton opening means 40 comprises a pair of suction cups 42, each of which has a first suction face 44. The suction cups 42 are mounted on a T-shaped support arm 46 which is mounted in a mounting bracket 48. The mounting bracket 48 is in turn supported by a support beam 68 which is an integral part of the frame 60. A slot 70 is formed in the support beam 68 along which a mounting pin 72 of the mounting bracket 48 may be moved to adjust the position of the suction cups 42 as required in use. The mounting bracket 48 is adapted to permit the arm 47 of the T-shaped support arm 46 to move longitudinally to provide further adjustment for the position of the suction cups 42.

The rotary transfer mechanism 50 is constructed in accordance with the rotary transfer mechanism described in my prior U.S. Pat. No. 3,937,458 dated Feb. 10, 1976 and the mechanism required to effect the required movement of the rotary transfer mechanism will not be described herein in detail. The rotary transfer mechanism 50 includes a first pair of suction cups 52 and a second pair of suction cups 54 which have transfer suction faces 56 and 58 respectively. The suction cups 52 and 54 are mounted on arms 70 and 72 which project from opposite sides of a suction head 74. The head 74 is mounted on a shaft 76 which is connected through gearing located in housing 78 to power input shafts 80 which are rotably driven about a central axis 82.

A drive motor 84 is connected to a gearbox 86 which has an output shaft 88 upon which a sprocket 90 is mounted. A drive chain 92 connects the sprocket 90 to a sprocket 94 which is mounted on a shaft 96 and bearings 98 support opposite ends of the shaft 98 for rotation. Sprockets 100 are mounted on the shaft 96 for rotation therewith and are connected to sprockets 102 by means of drive chains 104. The sprockets 102 are keyed to the power input shafts 80 of the rotary transfer mechanism 50.

Suction control means generally identified by the reference numeral 28 is provided for the purpose of controlling the timing at which a negative suction pressure is generated and relieved at the suction faces 56 and 58 of the suction cups 52 and 54 respectively. The suction control means 28 consists of cams 106 and 108 which are secured for rotation with the shaft 96. A suction control valve 110 has cam followers 112 and 114 mounted thereon, so as to bear against the cams 106 and 108 respectively, so as to be displaced in response to rotation of the cams 106 and 108. The cam followers 112 and 114 are independently displacable between first and second positions in which the suction control valve 110 is operable to generate a negative pressure or to relieve a negative pressure at the suction faces 58 and 56 respectively as required in use. The cam 106 has an arcuate cam track portion 106A between which a further cam portion 106B extends. Similarly, the cam track 108 has an arcuate portion 108A and a further portion 108B. When the cam followers are travelling along the arcuate portions 106A and 108A, the valve 110 is operable to release negative pressure and when the cam followers 112 and 114 are travelling along the cam faces 106B and 108B, the valve 110 is operable to apply a negative pressure at the suction faces. The cam 110 controls the pressure at the suction faces 56 of the suction cups 52 and the cam 106 controls the pressure at the suction faces 58 of the suction cups 54. Conduits 120 and 122 communicate with the suction faces 56 and 58 respectively through passages formed in the suction heads 74 and arms 70 and 72 and communicate through the valve 110 with a suitable vacuum source or atmosphere.

Figure 3:
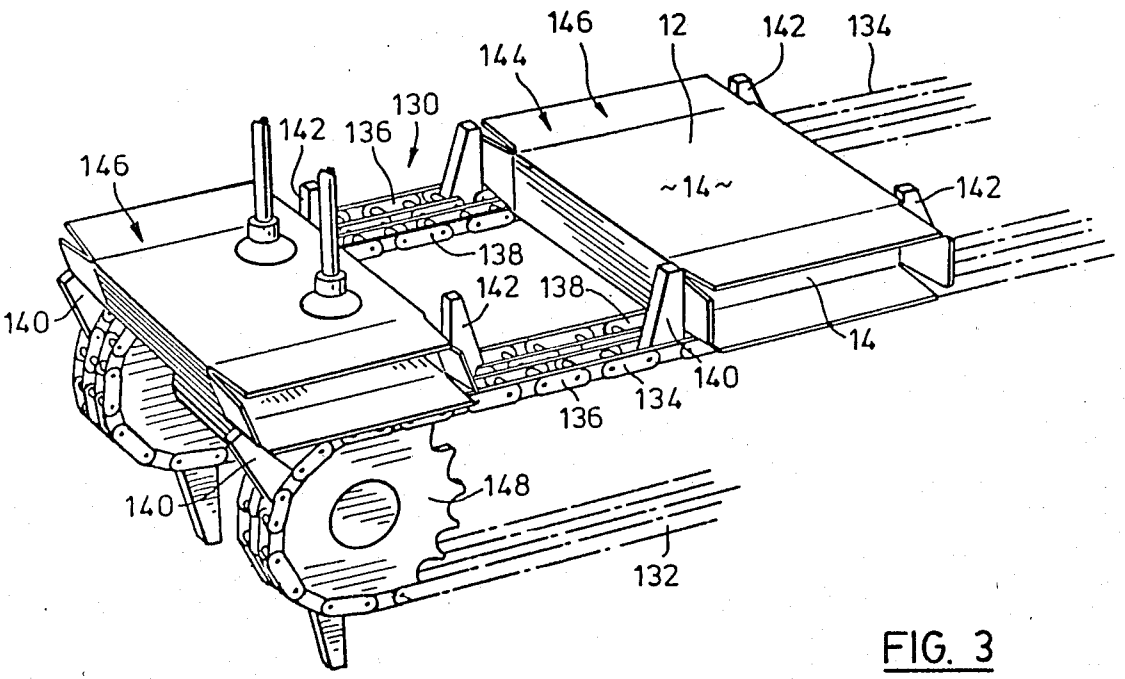
FIG. 3 is a pictorial view of a receiving conveyor showing the open cartons mounted thereon.

With reference to FIG. 3 of the drawings, the reference numeral 130 refers generally to a receiver for receiving open cartons. The receiver is in the form of a conveyor 132 which comprises two chain sets 134, each of which consists of a first chain 136 and a second chain 138. Fingers 140 are mounted at spaced intervals along the chains 136 and fingers 142 are mounted at spaced intervals along the chains 138. A carton receiving compartment 144 is formed between oppositely disposed side faces of the fingers 142 and 140 and has an upwardly opening entranceway 146. The chains 134 and 136 extend around sprockets 148 such that when the fingers 140 are travelling around the curve formed by the sprockets 148, the entranceway 146 will be enlarged to facilitate the entry of a partially opened carton.

In use, the rotary transfer mechanism is rotatably driven to cause the suction cups 52 and 54 to travel along the locus 150 (FIG. 4). As a result of this motion, the first suction cup 52 is initially moved to a first position in which its suction face 56 is compressed against the panel 14 of the first carton 12 which is located in the storage magazine 32. The cam 108 is operable to ensure that a negative suction pressure is applied at the suction face 56 as the suction cup 52 approaches the carton 12 and this suction serves to secure the carton 12 with respect to the suction cup 52 to permit it to be withdrawn from the magazine 32. The suction cup 52 is then driven to a second position in which the other main panel 14 is compressed against the suction face 44 of the suction cups 42 to a sufficient extent to temporarily secure the second panel 14 to the suction faces 44 to a sufficient extent to ensure that as the suction cup 52 is driven away from the second position toward a third position, the second panel 14 will be temporarily retained by the suction cups 42 thereby to cause the knocked-down carton 12 to move toward an open position by hinging along the hinge lines 18, 20, 22 and 24 to the partially open position shown in FIG. 4. Thereafter, the suction cup 52 is driven to a third position in which it extends into the entranceway 146 of the first compartment 144 of the receiver 130. At this point, the negative pressure applied by the valve 110 is relieved so as to release the carton 12 to permit it to remain in the compartment 144 as the suction cup 52 is driven away from the compartment 144 to be returned to the first position to repeat the cycle.

As the fingers 140 are driven to an upright position in which they extend parallel to the fingers 144 of the conveyor 132, they engage a trailing end panel 16 to cause the carton 12 to articulate to the fully open configuration illustrated in FIG. 3.

It will be understood that the suction cups 54 operate in the same manner as the suction cups 52 to dispense open and deposit an open carton which is located 180 degrees out of phase with the cycle of the suction cups 52.

From the foregoing, it will be apparent that the present invention provides a simple and efficient carton opening mechanism which is capable of operating at high speed and which provides for the positive opening of a carton without the difficulties previously encountered when attempting to open a carton by striking it on the edge about which it is hinged to a knock-down configuration.

I claim:

1. A carton opening mechanism for use in opening a knocked-down carton and transferring the open carton to a receiver having a receiver compartment proportioned to receive an open carton, said receiver compartment having an entranceway opening therefrom, comprising;

(a) a carton storage means having a discharge opening through which knocked-down cartons may be withdrawn one at a time, (b) carton opening means having a first suction face, (c) said discharge opening and first suction face being circumferentially spaced 120 degrees from one another about the perimeter of a circle and facing inwardly toward a central axis located at the center of said circle, (d) said carton opening mechanism being mounted so as to locate the receiver compartment on the perimeter of said circle equidistant from the discharge opening and first suction face with the entranceway of said compartment opening toward said central axis, (e) a rotary transfer means mounted for rotation about said central axis, said transfer means having a suction head formed with a transfer suction face, said transfer means being operable, in response to continuous rotation thereof, to effect movement of said transfer suction face along a triangular path which has first, second and third shallow concave arcuate portions which extend, respectively, between, (i) a first position in which the transfer suction face is located at a first apex of said triangular path and is directed toward said discharge opening and positioned to engage a wall of a carton blank located in the storage means in use, and (ii) a second position in which the transfer suction face is located at a first apex of said triangular path and is directed toward and disposed opposite the first suction face of said carton opening means to press an opposite wall of the carton into engagement with the first suction face, and between said second position and, (iii) a third position in which the transfer suction face is located at a first apex of said triangular path and is directed toward and disposed adjacent the entranceway of the receiver to deposit an open carton in said receiver compartment in use, and between said third position and said first position, (f) suction control means adapted to generate a negative pressure at said transfer suction face when it is in said first position and during movement of said transfer suction face between said first, second and third positions so as to secure a wall of a knocked-down carton thereto, withdraw it from the storage means, transported to and open it by engagement with the opening means and deposit the open carton in the receiver compartment and thereafter to relieve the negative pressure to release the open carton.

2. A carton opening mechanism as claimed in claim 1 wherein the carton opening means comprises a pair of suction cups.

3. A carton opening mechanism comprising;

(a) a carton storage magazine having a discharge opening through which knocked-down cartons may be withdrawn one at a time, (b) carton opening means having a first suction cup which has a first suction face formed thereon, (c) an endless conveyor on which a plurality of receiving compartments are formed at longitudinally spaced intervals, each of said receiver compartment having an entranceway opening therefrom, (d) said discharge opening, said first suction face and the entranceway of a first of said receiving compartments being circumferentially spaced 120 degrees from one another about the perimeter of a circle and facing inwardly toward a central axis located at the center of said circle, (e) a rotary transfer means mounted for rotation about said central axis, said transfer means having a suction head formed with a transfer suction face, said transfer means being operable, in response to continuous rotation thereof, to effect movement of said transfer suction face along first, second and third shallow concave arcuate paths which extend, respectively, between, (i) a first position in which the transfer suction face is directed toward said discharge opening and positioned to engage a wall of a carton blank located in the storage means in use, and (ii) a second position in which the transfer suction face is directed toward and disposed opposite the first suction face of a carton opening means to press an opposite wall of the carton into engagement with the first suction face, and between said second position and, (iii) a third position in which the transfer suction face is directed toward and disposed adjacent the entranceway of the receiver to deposit an open carton in a receiver compartment in use, and between said third position and said first position (f) suction control means adapted to generate a negative pressure at said transfer suction face when it is in said first position and during movement of said transfer suction face between said first, second and third positions so as to secure a wall of a knocked-down carton thereto, withdraw it from the storage means, transported to and open it by engagement with the opening means and deposit the open carton in the receiver compartment and thereafter to relieve the negative pressure to release the open carton.

* * * * *